US006564520B1

(12) United States Patent
Starke et al.

(10) Patent No.: US 6,564,520 B1
(45) Date of Patent: May 20, 2003

(54) SHEET-LIKE MASONRY BLOCK DRAINAGE SYSTEM

(75) Inventors: Donald A. Starke, Golden, CO (US); John A. Striednig, Valley Park, MO (US); Keith R. Bartlett, Rowley, MA (US); Robert F. Jenkins, Wakefield, MA (US)

(73) Assignee: W. R. Grace & Co.-Conn, Columbia, MD (US)

( * ) Notice: Subject to any disclaimer, the term of this patent is extended or adjusted under 35 U.S.C. 154(b) by 0 days.

(21) Appl. No.: 09/869,821

(22) PCT Filed: Jan. 3, 2000

(86) PCT No.: PCT/US00/00036

§ 371 (c)(1),
(2), (4) Date: Sep. 6, 2001

(87) PCT Pub. No.: WO00/40809

PCT Pub. Date: Jul. 13, 2000

Related U.S. Application Data

(60) Provisional application No. 60/114,780, filed on Jan. 5, 1999.

(51) Int. Cl.[7] ..... E04B 1/70

(52) U.S. Cl. ..... 52/302.1; 52/409

(58) Field of Search ..... 52/169.5, 302.1, 52/409; 428/40

(56) References Cited

U.S. PATENT DOCUMENTS

| | | | | | |
|---|---|---|---|---|---|
| 1,429,740 | A | * | 9/1922 | Jordan | 52/411 |
| 1,734,777 | A | | 11/1929 | Pike | 52/169.14 |
| 3,092,933 | A | | 6/1963 | Closner et al. | 52/169.14 |
| 3,581,631 | A | * | 6/1971 | Samson et al. | 404/75 |
| 3,663,350 | A | * | 5/1972 | Stokes | 428/220 |
| 3,900,102 | A | * | 8/1975 | Hurst | 206/411 |
| 4,396,665 | A | * | 8/1983 | Rowe | 428/148 |
| 4,442,148 | A | * | 4/1984 | Stierli | 428/40.3 |
| 4,733,989 | A | | 3/1988 | Harriett | 405/43 |
| 4,745,716 | A | | 5/1988 | Kuypers | 52/169.5 |
| 4,840,515 | A | | 6/1989 | Preese | 405/45 |
| 4,943,185 | A | * | 7/1990 | McGuckin et al. | 405/45 |
| 5,044,821 | A | | 9/1991 | Johnsen | 405/50 |
| 5,184,437 | A | | 2/1993 | Woong et al. | 52/169.5 |
| 5,318,832 | A | * | 6/1994 | Fishel et al. | 442/392 |
| 5,692,348 | A | | 12/1997 | Ambrosino | 52/169.5 |
| 5,860,255 | A | | 1/1999 | Fishel et al. | 52/169.14 |
| 6,023,892 | A | * | 2/2000 | Sourlis | 52/169.5 |

FOREIGN PATENT DOCUMENTS

| | | | |
|---|---|---|---|
| GB | 2155076 | 9/1985 | 52/169.5 |

* cited by examiner

*Primary Examiner*—Carl D. Friedman
*Assistant Examiner*—Basil Katcheves
(74) *Attorney, Agent, or Firm*—Craig K. Leon, Esq.; William L. Baker, Esq.

(57) ABSTRACT

A masonry block drainage system comprising a sheet-like waterproofing strip for water-sealing the top of masonry blocks having vertically-extending cavities, at least one drainage fabric member, and at least one weep member for draining water from the drainage fabric member.

25 Claims, 6 Drawing Sheets

SHEET-LIKE MASONRY BLOCK DRAINAGE SYSTEM

This application claims the benefit of U.S. Provisional application No. 60/114,780, filed Jan. 5, 1999.

FIELD OF THE INVENTION

The present invention relates to a drainage system for collecting seepage water in and draining it from the interior cavities of a masonry block wall back to a location outside of the masonry block cavity.

BACKGROUND OF THE INVENTION

Masonry blocks are notorious for allowing water on the exterior side of the wall to enter into its central cavities through the joints between the blocks or through the blocks themselves. Once water has entered into the block cavities, it tends to seep inside the building and cause moisture problems. Water within the blocks and on their surfaces can cause damage to interior and exterior wall finishes.

There have been several attempts to solve the problem of water seepage through masonry block walls. For example, some have tried using blocks in the bottom course that have openings to drain the water from inside the block cavities to a gravel bed, and subsequently into a drain tile. Such systems were disclosed in U.S. Pat. No. 4,333,281 of Scarfone and U.S. Pat. No. 4,612,742 of Bevilacqua.

Others have tried to solve seepage problems by placing blocks at the bottom course that have interconnecting lateral slots which allow the water to drain laterally into an adjacent block. The water then drains to the exterior of the block wall by either a drain pipe extending from one of the blocks, as shown in U.S. Pat. No. 3,562,982 of Parezo, or by openings in the bottom course blocks which direct water to a gravel bed and subsequently to a drain tile, as shown in U.S. Pat. No. 4,486,986 of Cosenza.

Others have tried to solve masonry block drainage problems by placing a thin vent structure beneath the bottom block course to draw the water toward a gravel bed, which then directs the water to a drain tile. Such a system is shown in U.S. Pat. No. 4,381,630 of Koester.

One drawback of the abovementioned drainage systems is that they do not prevent water within the block cavities from contacting and seeping through the walls of the interior block cavities as it drains down through such cavities. Water passing from upper courses to lower courses must run down the walls of the interior cavity, causing such walls to become saturated with water, which eventually seeps to the interior and exterior surfaces of the building. One way to avoid this problem, as disclosed in U.S. Pat. No. 2,147,035 of Henderson, was to insert across vertical voids in the blocks a tar paper having holes punched in the middle to direct seepage from the outer walls toward the center of the voids. The seepage water was then drained at the bottom course of masonry blocks, where the water could be directed through holes in block externally and also internally beneath a floor slab.

Another drawback of many of the aforementioned drainage systems, moreover, is that they drain water toward the inside of the building rather than directing it to the exterior of the building away from the internal parts of the building. Such systems promote saturation of the ground underneath the wall and building structure. They are difficult to install and hinder access to gravel beds and drain tiles under the structures.

Another problem with many, if not most, of the aforementioned drainage systems is that they do not collect water from the block cavities at a level other than the bottom course. Consequently, water that has entered a block wall at upper courses must run down the walls of the interior cavities to the bottom course before it drains. In so doing water inherently contacts and seeps through the blocks to the inside of the building. Thus, it was disclosed in U.S. Pat. No. 4,910,931 of Pardue to employ a system of upper water collection pans having downspouts leading from drain openings in the upper collection pans to drain collected water from the pans through the vertical block cavities in lower block courses to the next lower series of collection pans. A lowermost series of base collection pans then collected water drained through the vertical block cavities from the upper pans, and the water in the base collection pans were then diverted to the exterior of the wall using weeping spouts which projected laterally from the base collection pans. One of the difficulties of these kinds of drainage pan systems, however, is the necessity for the pans and masonry block cavities to be conformed to each other. In other words, the pans and other parts of the drainage system must be made to fit the particular masonry block shape and into the particular cavity dimensions. This often present considerable inconvenience to the masonry applicator who must be careful to obtain the correctly fitting drainage system devices to fit the masonry block structures.

In view of the disadvantages of the prior art, a novel and inventive masonry block drainage system is needed.

SUMMARY OF THE INVENTION

In surmounting the disadvantages of the prior art, the present invention provides a novel sheet-like masonry block drainage system which is convenient and easy to manufacture and use.

An exemplary masonry block drainage system of the present invention comprises a sheet-like waterproofing strip for water sealing a masonry block having at least one vertically-extending cavity therein; at least one drainage fabric member; and at least one weep member for draining water from the at least one drainage fabric member.

The waterproofing strip is preferably a rollable sheet, which can be made of polyolefin or other materials, having a width sufficient to prevent water from entering the vertically-extending cavities of masonry blocks. Exemplary waterproofing strips have means for providing a waterproofing seal around the masonry block cavities, such as a waterproofing adhesive or a keying structure for providing a bond with fresh mortar applied to the top of the masonry block. The drainage fabric member is preferably attached to the waterproofing strip by an adhesive or embedded into the strip, and permits seepage water to be drained by weep members which are preferably spaced at intervals along the side of the waterproofing strip. Water is drained from the drainage fabric member to a location external to the masonry block cavities.

The masonry block drainage device and systems herein described are preferably rollable so that they can be transported to and installed at the application site with relative ease. It is thus relatively easy to adjust the width of the waterproofing strip and drainage fabric member, such as by cutting, to facilitate installation at the site. More often than not, the masonry drainage systems can be produced in a number of standard widths and be applicable to variously shaped masonry blocks. The use of drainage fabric members which are generally coextensive with, and preferably adhered to, or otherwise attached to, the waterproofing strip member, allows seepage water to be collected and distributed to more than one weep member. This is indeed beneficial because it increases drainage rate and means that seepage water can be drained from mortar block cavities even when some weep members get clogged by dirt, debris, or masonry mortar.

Another benefit of the invention is that lateral migration of seepage water from one masonry block cavity to another can be achieved without the use of drilled or shaped holes in the block and without complex, expensive drainage pipes or structures placed within the masonry block cavities or under each masonry block course or the bottom-most course. Further features and advantages of the invention are provided hereinafter.

BRIEF DESCRIPTION OF THE DRAWINGS

An understanding of the following detailed description of preferred embodiments of the invention may be facilitated by reference to the accompanying figures, wherein.

DETAILED DESCRIPTION OF EXEMPLARY EMBODIMENTS

Figure 1:
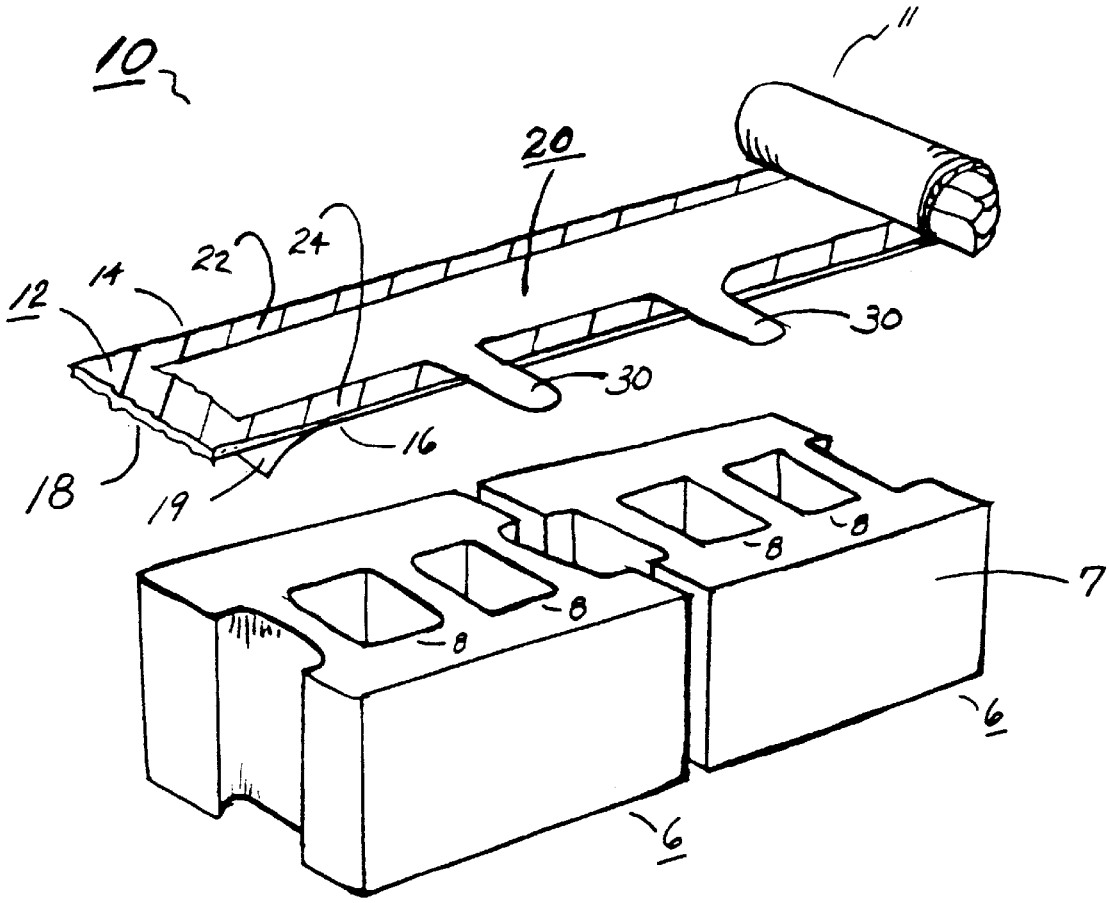
FIG. 1 is a perspective view of an exemplary masonry block drainage system of the present invention which is designed to be adhered onto the top of masonry blocks having vertical internal cavities.

As shown in FIG. 1, an exemplary masonry block drainage system 10 of the present invention may be provided in a convenient roll form 11 that can be unrolled at the construction site and adhered directly onto the top of a course of masonry blocks 6 having vertically-extended (or oriented) cavities 8. Masonry blocks are typically used for making walls and other building structures.

An exemplary masonry block drainage system 10 comprises a waterproofing strip 12 having a generally planarly extending sheet body comprising a first major face (which will be downward facing when installed) and a second major face (upwardly disposed when installed as shown) extending between longitudinally extending roll edges 14 and 16 of the strip 12.

The exemplary waterproofing strip 12 has means for water-sealing around the cavities 8 of the masonry block 6, such as a pressure-sensitive waterproofing adhesive 18 adhered onto the first face of the waterproofing strip 12 for attaching the drainage composite device 10 onto the top of the masonry block and thus preventing water from entering the vertical cavities 8 of the blocks. Thus, the width of the strip body sheet 12 should be slightly greater than the width of the block cavity 8, and preferably less than the width of the masonry block 6, so that after the strip 12 is installed on top of the blocks 6, then mortar can be applied along the side of the strip to cement the masonry block course to the next masonry block course.

The waterproofing strip 12 is preferably a continuous sheet that is made of plastic, paper, metal, glass, or combination thereof. Preferably, a polyolefin, such as polyethylene or polypropylene, is used. In combination with a bituminous waterproofing adhesive 18, the use of a polyolefin sheet material is preferred.

Known pressure-sensitive waterproofing adhesive materials may be used, such as bituminous adhesives, rubber-modified bituminous adhesives, non-bituminous synthetic adhesives (e.g., styrene-isoprene-styrene, styrene-butadiene rubber, ethylene propylene diene monomer rubber), or mixture thereof, may be suitably employed on either or both of the major faces of the waterproofing strip 12. A conventional waterproofing adhesive layer or strip 18 may be coated or laminated onto a plastic film for example, to obtain the waterproofing strip member 12, and may be provided as a continuous layer extending from one longitudinal edge (14) to the other (16) of the waterproofing strip 12.

A release liner sheet 19, which can be made of siliconized or waxed paper or plastic, serves to protect the waterproofing adhesive layer 18, and is removed just before application, such as by peeling, or while the drainage device 10 is unrolled onto the blocks 6.

Also shown in FIG. 1 is an exemplary drainage fabric member 20 positioned against the first face (and thus, when installed, located on top) of the waterproofing strip 12. The drainage fabric member 20 preferably has a generally sheet or sheet-like (i.e., it is flat and rollable) form that extends longitudinally with the strip 12. The drainage fabric member 20 may have the same or a smaller width than the strip 12 The exemplary drainage fabric member 20 shown comprises a strip of fabric, preferably non-woven, the purpose of which is to allow water to escape from the internal cavities of (subsequently installed) masonry blocks while resisting pluggage by dirt, debris, or mortar (which falls into the cavities of subsequently installed masonry block courses). Preferred non-woven fabrics are heavy felts or spun-bonded polyolefins or polyesters, such as the type used in soil filter fabrics and geotextiles. Fabric thicknesses are preferably greater than 1–3 mils, depending upon the density of the fabric. Thicker and/or heavier fabrics are preferred, since this means that water drainage capacity of the drainage fabric member 20 is enhanced and that the fabric can still function to drain water even when mortar happens to drop onto the fabric. Thus, for example, a nonwoven fabric may have a weight of 136 $g/m^2$ (4 $oz/yd^2$) to 270 $g/m^2$ (8 $oz/yd^2$). Preferably, the drainage fabric member 20 is adhered (by adhesive or glue -not shown), melt-bonded, or otherwise attached to the upper face of the waterproofing strip member 12 to avoid relative movement therebetween.

The masonry block drainage system 10 also comprises at least one weep member 30, and preferably a plurality of spaced-apart weep members, in communication with the drainage fabric member 20 and extending beyond the longitudinally-extending edge 16 of the waterproofing strip member 12 The function of weep members 30 is to provide a conduit so that water collected by the drainage fabric member 20 can flow to a location away from the masonry block cavities 8, such as to a location on the external face of the blocks 6. Exemplary weep members have generally elongated bodies having or defining a conduit channel, the bodies extending away from the longitudinally-extending edge 16 away from the strip member 12 Preferably, numerous spaced-apart weep member 30 are used along the edge of the masonry block drainage device 12.

For convenience, the weep members 30 and the drainage fabric member 20 may be integrally formed from the same fabric sheet (as is shown in FIG. 1). This may be done simply by cutting portions from the longitudinally-extending edge 14 of the woven or non-woven fabric sheet 20 to form extending weep members 30 that are shaped to extend to the edge of the outermost edge of the masonry block when the device 10 is properly installed over the cavities 8 of the block 6. Optionally, fabric strips, ropes, tubing, drainage cores, or other water conduits can be placed on top of and/or beneath the weep members 30. The weep members 30 themselves may also be attached as separated pieces, such as by laying thick fabric strips (preferably nonwoven), ropes, cords, or other porous members upon the edge of the drainage fabric member 20 at intervals along the longitudinally-extending waterproofing strip edge 16, such that water may be drained away from the drainage fabric member 20 to a location external to the masonry block 6 course. Optionally, a corrugated strip or other support structure can be positioned over the weep members to resist collapse due to subsequently applied mortar and/or blocks.

In other exemplary masonry block drainage systems 10, a second waterproofing adhesive can be positioned on the second face (shown disposed upward) of the waterproofing strip 12, such that, at the (upwardly-facing) longitudinally-extending second face edges 22 and 24 of the waterproofing strip 12, mortar cement may be applied (onto the partially-exposed masonry block 6 and also onto the partially-exposed waterproofing strip upward face) for the next course of masonry blocks. The second waterproofing adhesive can be similar in composition to the first waterproofing adhesive 18, and is operative to form a mechanical bond when the mortar is applied onto it and allowed to cure. The second waterproofing adhesive may be applied onto the waterproofing strip 12 second major face in a manner to cover the second face entirely or to cover only a portion of that face along the longitudinally-extending upwardly facing outer edges (as shown at 22 and 24). Preferably, the second waterproofing adhesive is in the form of a layer 40 (See FIG. 2) which has an optional protective coating 42, such as an elastomeric layer to protect the adhesive. Both the adhesive and coating layers are operative to bond with fresh mortar that is brought into contact with them and allowed to cure. The use of a protective coating layer 42 over bituminous and non-bituminous synthetic adhesive layers which are used for bonding with concretes and mortars is known in the art and taught in U.S. Pat. No. 4,994,328 of Cogliano; U.S. Pat. No. 5,316,848 of Bartlett et al.; and also U.S. Pat. No. 5,496,615 of Bartlett et al., all of which are incorporated fully herein by reference.

Figure 2:
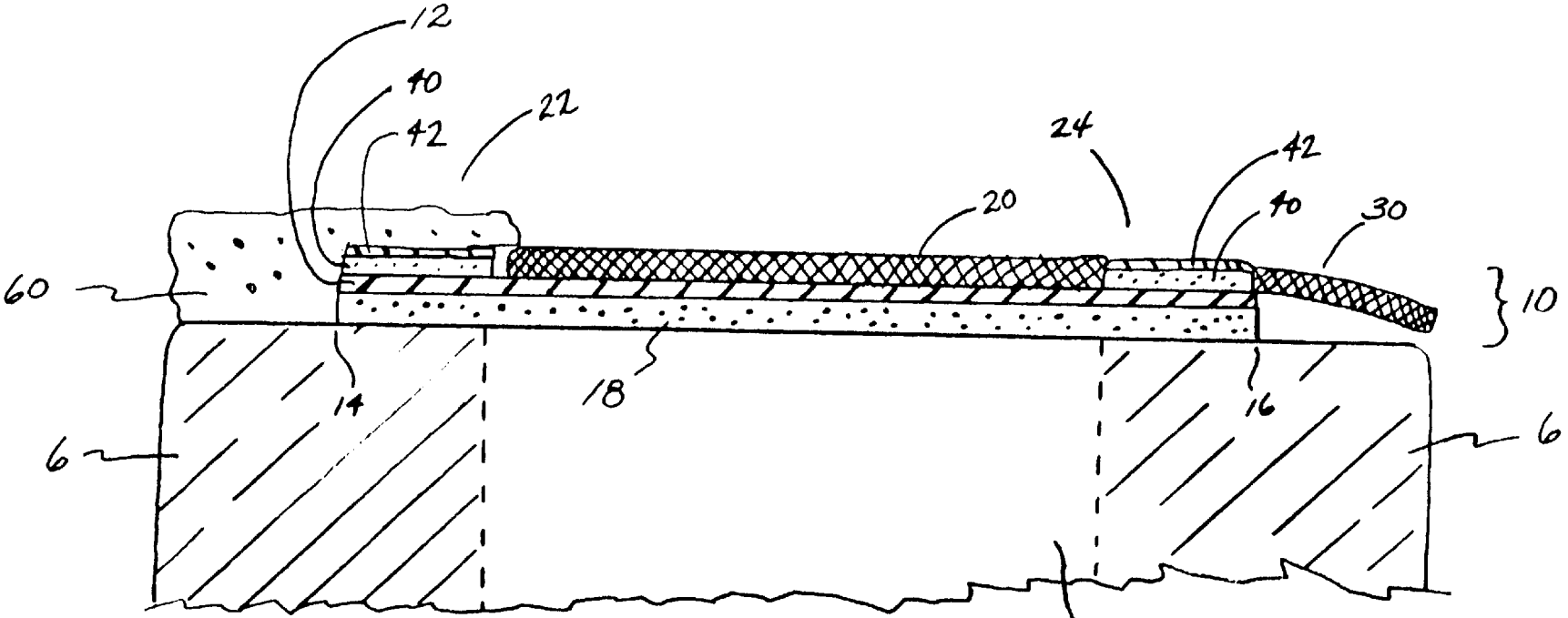
FIG. 2 is cross-sectional view of the exemplary masonry block drainage system of FIG. 1 when adhered into place on top of masonry blocks.

As shown in the cross-sectional view of FIG. 2, an exemplary masonry block drainage system 10 is adhered to the masonry block 6 over the vertical block cavity 8. The waterproofing strip member 12 with the first waterproofing adhesive layer 18 should have a longitudinally-extending edge-to-edge width that is slightly greater than the vertical cavity 8 (and preferably narrower than the width of the masonry block. 6. The drainage fabric member 20 preferably has (but does not necessary have to have) a strip width less than that of the waterproofing strip 12 width, so that a second waterproofing adhesive 40 can be used at exposed, upwardly facing waterproofing strip portions 22 and 24 to bond with mortar 60 that is subsequently applied to the outer top surface of the masonry block 6. (For simplicity of illustration, only one edge 22 is shown covered with mortar cement 60).

As shown in FIG. 2, the weep members 30 preferably extend along and beyond the longitudinally-extending edges of the waterproofing strip 12, thereby functioning as a channel to drain seepage water from the drainage fabric member 20 and to direct the water to a location beyond the edge of the masonry block 6. After mortar 60 is applied to the top surfaces of the block 6 and upon the second waterproofing adhesive 40 (preferably protected by an elastomeric coating 42) at the two upwardly facing portions 22 and 24, another masonry block course can then be positioned into place on top of the masonry block 6.

The second waterproofing adhesive 40 and optional protective coating 42, which is applied at 22 and 24 (See FIG. 2), is operative to bond, to mortar and is shown adhered along the edges of the upward face of the waterproofing strip 12.

Figure 3:
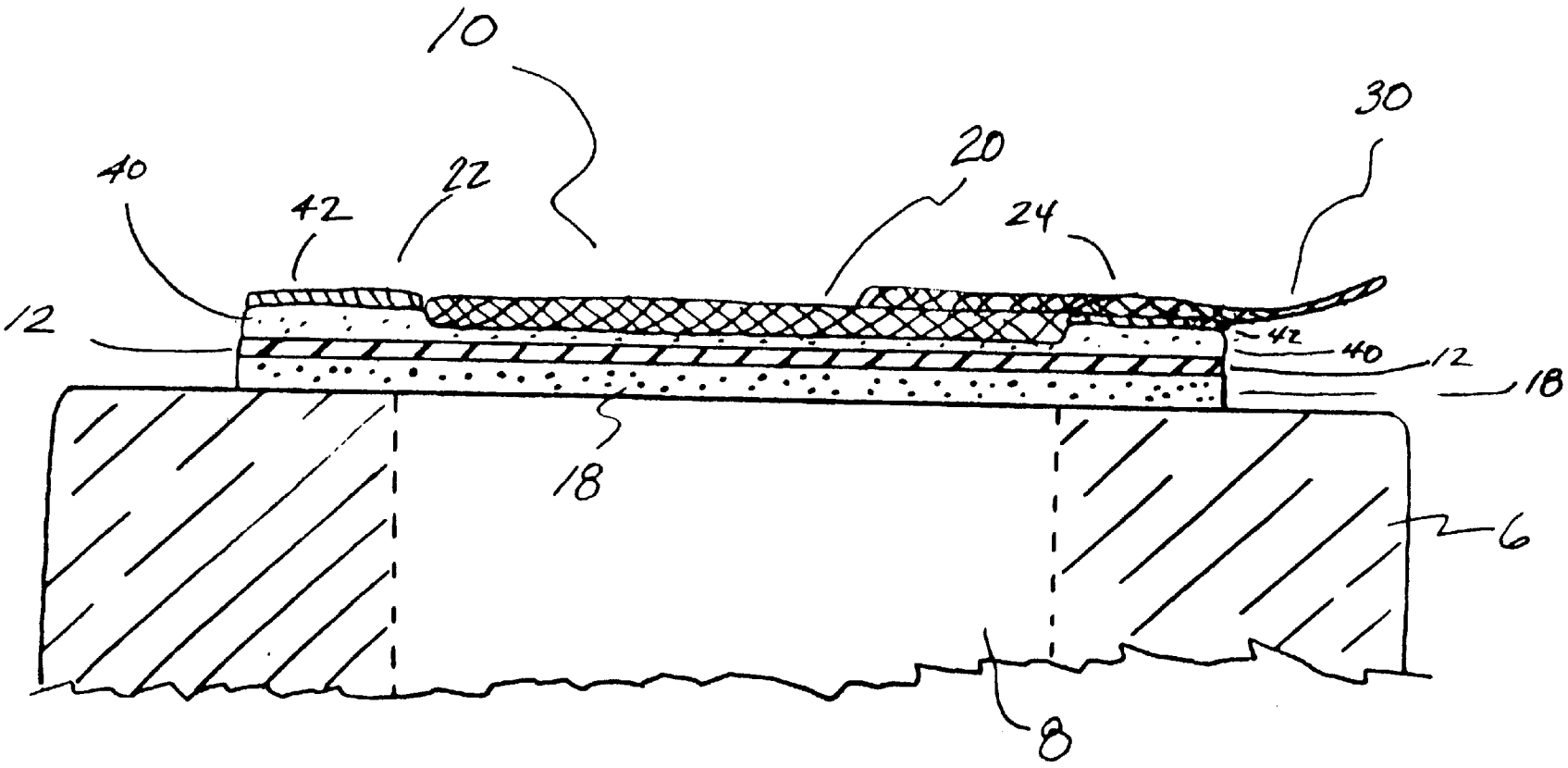
FIGS. 3–6 are cross-sectional views of other exemplary masonry block drainage systems of the invention.

A further exemplary masonry drainage device 10 is shown in FIG. 3. The second waterproofing adhesive layer 40, preferably a synthetic non-bituminous pressure-sensitive adhesive such as styrene-isoprene-styrene (SIS), can be applied as a continuous layer across the upward face of the waterproofing strip 12, and thus used to attach the drainage fabric member 20. Optionally, the second waterproofing adhesive layer 40 is thicker at the outer edge portions 22 and 24 in order to provide greater opportunity of forming a mechanical bond with fresh masonry cement applied at those locations (e.g., at 22 and 24) and allowed to cure, although this may not be necessary. The exemplary weep member 30 shown in Fi& 3 is formed from a separate piece of fabric and laid across the top of the drainage fabric member 20; this is believed to be sufficient for purposes of providing a water conduit from the drainage fabric member 20 to a location beyond the edge of the waterproofing strip 12 and beyond the block 6 to a location external to the masonry block cavity 8.

Figure 4:
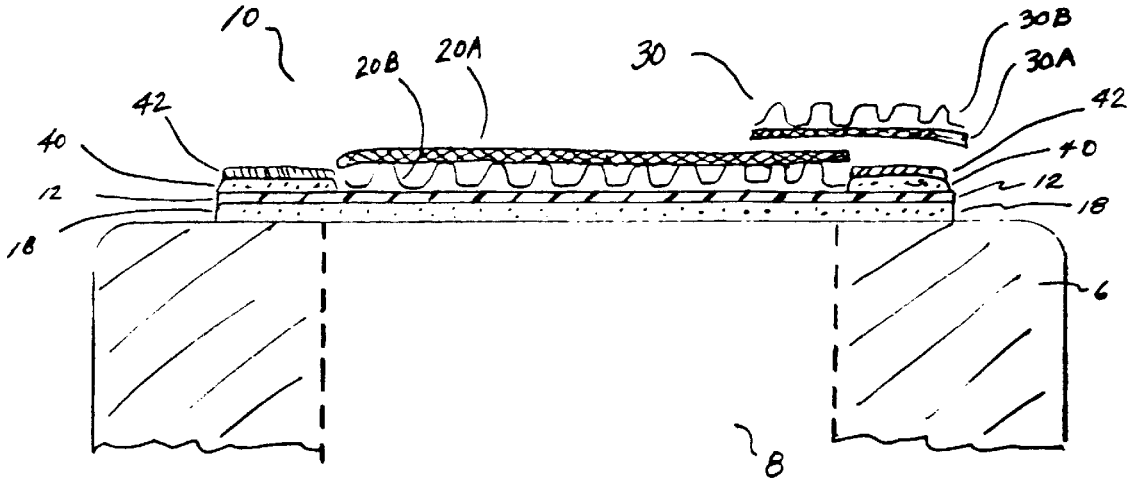

FIG. 4 illustrates another exemplary masonry block drainage device 10 of the invention in which the drainage fabric member 20 comprises a fabric sheet 20A supported on an open core support member 20B. The sheet is preferably a non-woven fabric, and the open core support member preferably comprises a plastic sheet (e.g., polypropylene or polyethylene) having dimples, e.g., frustconical cone shaped projections, to which the fabric sheet 20A is adhered at a distance spaced-apart from the sheet 20B. This open core matrix preferably permits water flow in two directions, namely, both longitudinally along and transversely across the drainage fabric member 20. The combination of fabric and core sheet (20A/20B) is commercially available, for example, from Grace Construction Products, Cambridge, Mass., under the tradename HYDRODUCT®. This commercial drainage product may be provided in roll form. Such a drainage filter member can be cut along one edge to form weep members, or the weep members can be added at the application site in the form of strips cut from the HYDRODUCT® composite product. Various composite drainage units are known and taught, for example, in U.S. Pat. Nos. 3,654,765; 3,812,001; 4,102720; 4,572,700; 4,574,541; 4,614,000; 4,631,221; 4,662,778; 4,733,989; and 4,943,185 all of which are incorporated by reference herein.

Figure 5:
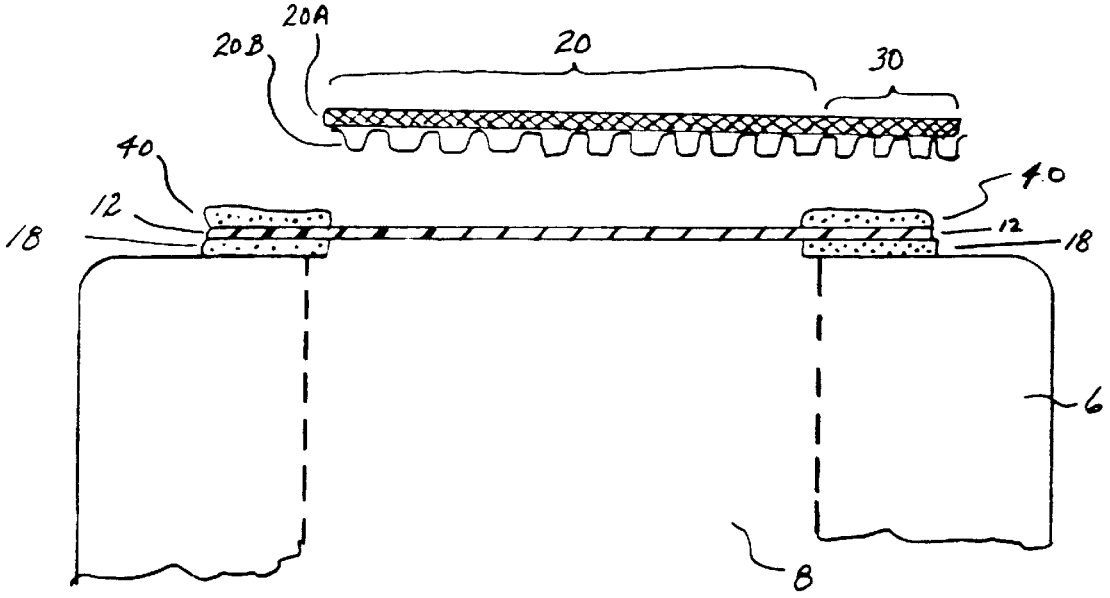

The drainage filter fabric 20A can also be a non-woven fabric that is spaced apart from the waterproofing strip by a corrugated plastic sheet 12B (similar to corrugated cardboard), as shown in the cross sectional lengthwise view of FIG. 5. Weep members 30 can be formed integrally out of the same fabric/corrugated material as the filter/sheet material 20A/20B.

FIG. 5 also illustrates an exemplary embodiment wherein a first waterproofing adhesive 18 and a second waterproofing adhesive 40 can be in the form of strips positioned along at the longitudinally-extending edges of the waterproofing strip 12. These adhesives 18/40 can be protected by peelable release sheet strips (not shown) that are removed at the time of application. The drainage member 20 comprising the fabric 20A and optional open core 20B can be laid down such that the weep members 30 are embedded into the adhesive 40 on one side, so as to prevent relative movement of the member 20. In this case, the open core structure prevents fabric in the weep members from being blocked by mortar that is subsequently applied.

Figure 6:
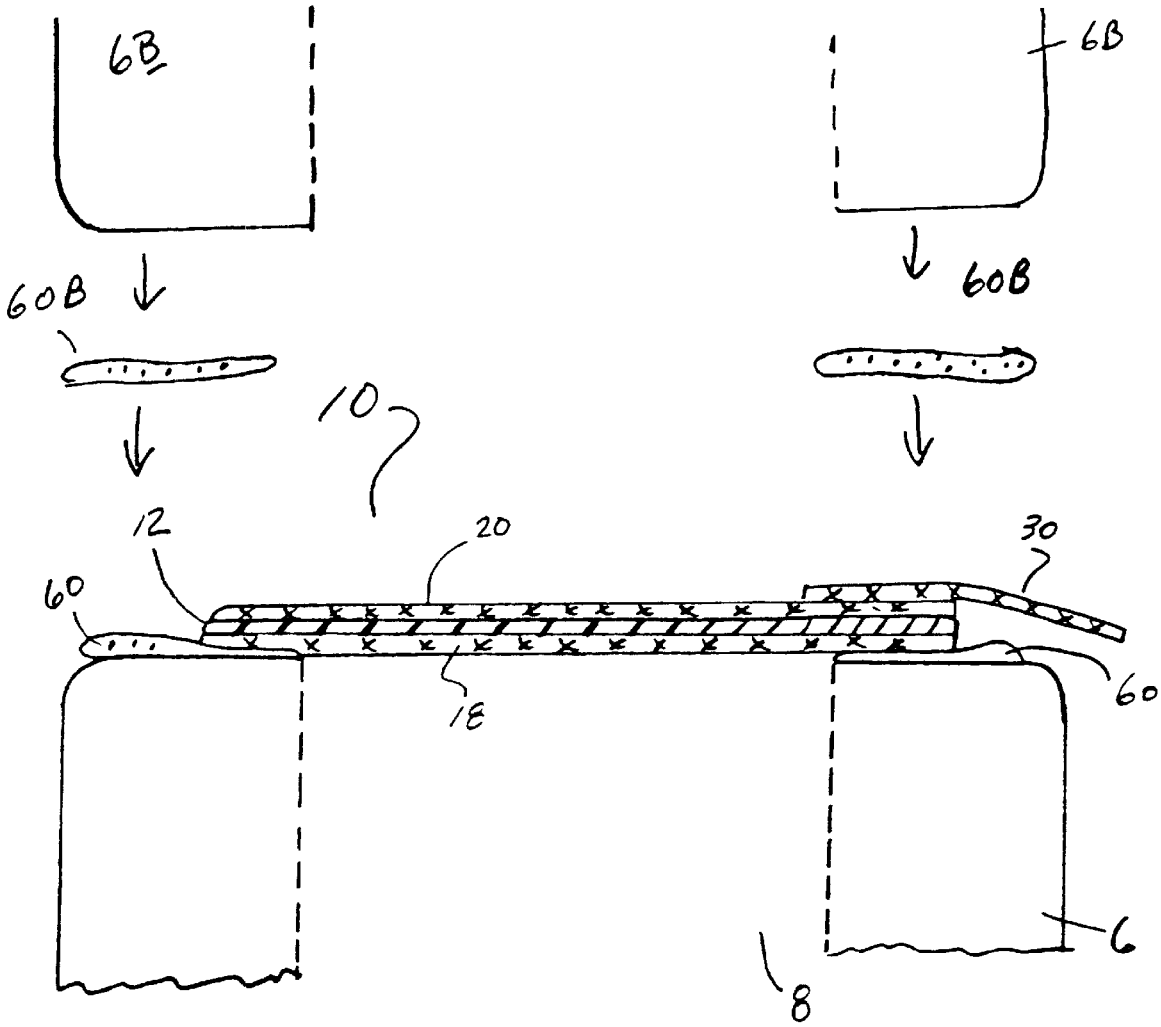

FIG. 6 is a cross-sectional view of another exemplary drainage device 10 of the present invention, wherein the waterproofing strip 12 preferably has fabric layers, preferably non-woven, positioned on both major faces. The non-woven fabric used as the drainage fabric member 20 can be made from the same material as the non-woven fabric attached to the opposed major face and used as a keying structure 18 for providing a waterproofing seal over the masonry block 6 cavity 8. To install the exemplary drainage device 10 shown, a layer of mortar cement (6) is applied on top of the masonry block 6 course around the vertically-extending cavities 8, and then the device 10 is unrolled on top of (and embedded into) the mortar cement 60; and then one or more weep members 30 (which can also be made of the same non-woven material) are then positioned on top of the device 10. (If the weep members are integrally formed from the same sheet as the drainage filter member 20, then labor is conserved at the application site). A second layer of mortar (60B) is then applied onto the top of the masonry blocks 6 and outer edge of the drainage fabric member 20. The mortar (60 and 60B) bonds with the non-woven fabric, which is preferably adhered to the waterproofing strip 12 using a conventional waterproofing adhesive or embedded into the strip, and the device 10 thus functions to divert water from entering into the vertically extending cavities 8 of the masonry block 6 underneath.

Further exemplary keying structures, in addition to fabrics (e.g., non-woven), include the use of fibers or "fuzz" which may be attached to or integral with the waterproofing strip 12 or even the use of surface roughness sufficient to key with the mortar. Such "keying" structures are known in the waterproofing art, and are believed to be suitable for bonding with fresh applied mortar as contemplated in the present invention.

Figure 7:
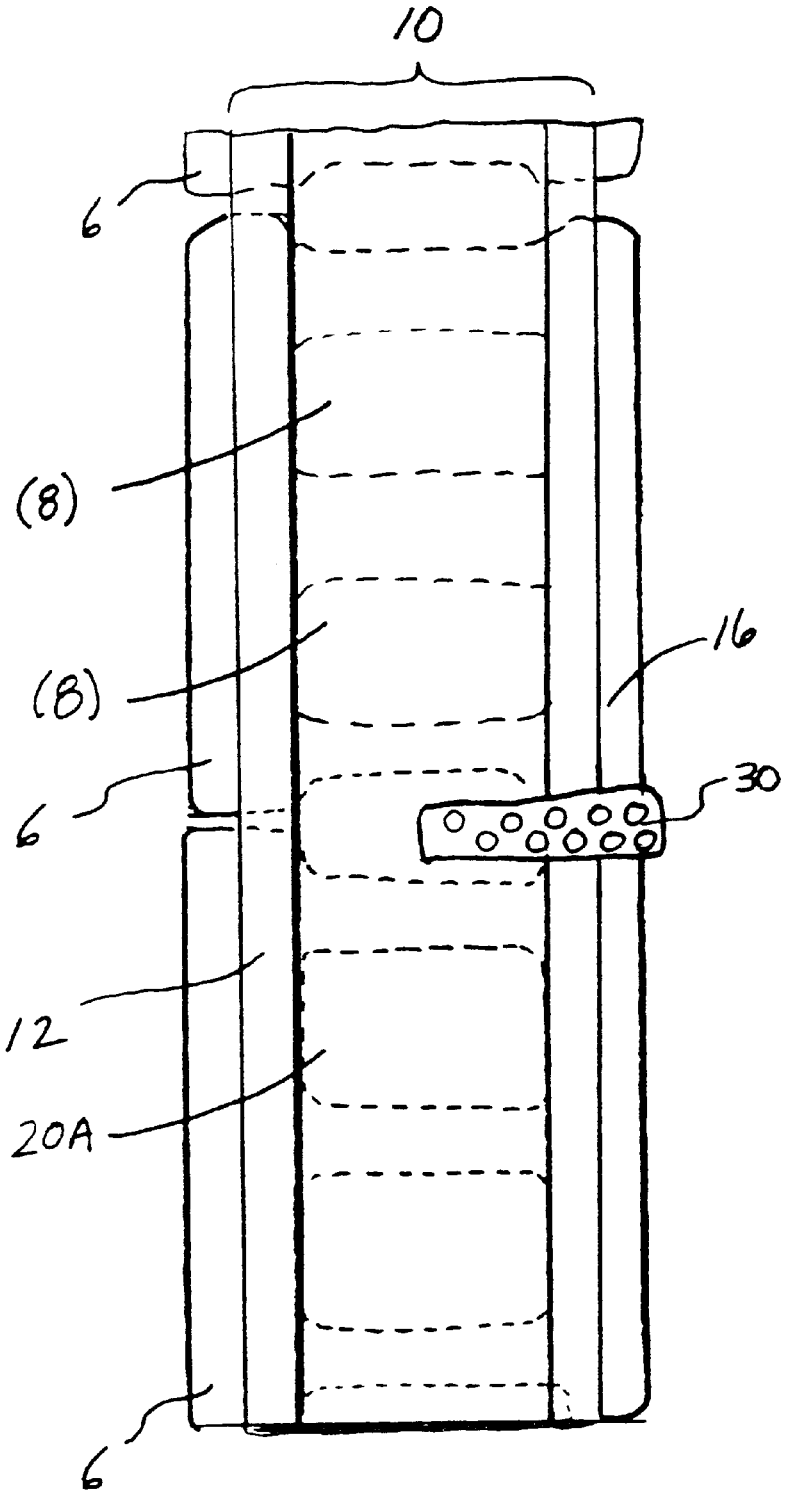
FIG. 7 is a top plan view of an exemplary masonry block drainage system of the invention.

FIG. 7 is a top plan view of an exemplary masonry block drainage system 10 of the present invention installed over the cavity (8) portions of mortar blocks. The drainage fabric 20A is shown preferably having a narrower width than the waterproofing strip 12 (also shown narrower for purposes of illustration). Exemplary weep members, such as shown at 30, can comprise inverted strips of HYDRODUCT® brand drainage product (soil filter fabric adhered to cuspated core), laid across the longitudinally-extending edge 16 of the device 10 and extending beyond the edge of the masonry block.

The foregoing examples are provided for illustration only and are not intended to limit the scope of the invention, as claimed.

We claim:

1. A masonry block drainage system comprising: a sheet-like waterproofing strip for water-sealing a masonry block having at least one vertically-extending cavity therein; at least one drainage fabric member comprising a non-woven fabric and an open core member for spacing said non-woven fabric a distance from said waterproofing strip; and at least one weep member for draining water from said drainage fabric member.

2. The drainage system of claim 1 wherein said waterproofing strip comprises a generally continuous sheet body having a first major face and a second major face opposite said first major face, said first major face having means for providing a waterproofing seal upon a masonry block having at least one vertically-extending cavity therein, said sealing means comprising a pressure-sensitive waterproofing adhesive, a keying structure operative to bond with fresh mortar placed upon said masonry block, or combination thereof.

3. The drainage system of claim 2 wherein said waterproofing strip sheet body is made from a polymeric material, paper, metal, glass, or combination thereof.

4. The drainage system of claim 2 wherein said pressure-sensitive waterproofing adhesive comprises a bituminous material, a non-bituminous synthetic material, or mixture thereof.

5. The drainage system of claim 4 wherein said pressure-sensitive waterproofing adhesive is provided in the form of a continuous layer on said waterproofing strip sheet body.

6. The drainage system of claim 2 wherein said keying structure comprises a non-woven fabric adhered onto said waterproofing strip sheet body.

7. The drainage system of claim 2 wherein said keying structure comprises fibers connected to said waterproofing strip sheet body.

8. The drainage system of claim 2 wherein said drainage fabric member comprises a generally elongated sheet-like body extending adjacent said second major face of said waterproofing strip.

9. The drainage system of claim 8 wherein said drainage fabric member has a width that is narrower than the width of said waterproofing strip sheet body.

10. The drainage system of claim 1 wherein said drainage fabric member comprises a woven or non-woven fabric.

11. The drainage system of claim 1 wherein said at least one weep member is integrally connected to said drainage fabric member.

12. The drainage system of claim 2 wherein said at least one weep member comprises a body separate from said waterproofing strip sheet body.

13. The drainage system of claim 1 further comprising a plurality of weep members operative to drain water from said drainage fabric member.

14. The drainage system of claim 1 wherein said waterproofing strip comprises a pressure-sensitive waterproofing adhesive and a protective release sheet that is releasably attached to said waterproofing adhesive.

15. The drainage system of claim 1 wherein said drainage fabric member is attached to said waterproofing strip to resist relative movement therebetween.

16. The drainage system of claim 1 wherein said waterproofing strip comprises a polymeric sheet and waterproofing adhesive on opposite major faces thereof.

17. The drainage system of claim 1 wherein said waterproofing strip comprises a polymeric sheet and non-woven fabric on opposite major faces thereof.

18. The drainage system of claim 17 wherein said non-woven fabric is adhered on said opposite major faces by waterproofing adhesive.

19. The drainage system of claim 1 wherein said waterproofing strip comprises a polymeric sheet, a non-woven fabric on one major face thereof, and a waterproofing adhesive on the other major face thereof.

20. The drainage system of claim 1 wherein said waterproofing strip comprises a waterproofing adhesive layer having a protective coating layer, said adhesive and coating layers being operative to bond with fresh mortar that is brought into contact with said layers and allowed to cure.

21. The drainage system of claim 1 comprising a plurality of weep members.

22. The drainage system of claim 1 wherein said waterproofing strip is rollable.

23. The drainage system of claim 1 wherein said at least one weep member comprises fabric, rope, tubing, sponge, polymer, or combination thereof.

24. A masonry wall drainage system comprising a first course of masonry blocks having vertically-oriented cavities and, adhered onto the top of said first course of said masonry blocks, the masonry block drainage system of claim 1.

25. A method for providing drainage to masonry blocks comprising:

providing at least one masonry block having a vertically-extending cavity, and applying to the masonry block over said cavity the masonry block drainage system of claim 1.

* * * * *